US005478147A

United States Patent [19]

O'Brien et al.

[11] Patent Number: 5,478,147

[45] Date of Patent: Dec. 26, 1995

[54] PORTABLE MIXER FOR MIXING GROUND RUBBER INTO LIQUID ASPHALT

[75] Inventors: Patrick C. O'Brien; Thomas R. Brown, both of Oregon, Ill.

[73] Assignee: E. D. Etnyre & Co., Oregon, Ill.

[21] Appl. No.: 421,193

[22] Filed: Apr. 13, 1995

[51] Int. Cl.[6] ..... B28C 5/16; B01F 7/20

[52] U.S. Cl. ..... 366/066; 366/157.4; 366/264; 366/307; 366/327.1

[58] Field of Search ..... 366/20, 38, 64–66, 366/156.1, 157.1–157.4, 158.3, 158.4, 244–246, 264, 266, 307, 325.3, 327.1–327.4, 329.1, 330.1

[56] References Cited

U.S. PATENT DOCUMENTS

| | | | |
|---|---|---|---|
| 740,752 | 10/1903 | Goss . | |
| 793,106 | 6/1905 | Spaeth . | |
| 1,753,716 | 4/1930 | Owen . | |
| 1,781,255 | 11/1930 | Trouth . | |
| 2,626,788 | 1/1953 | Ragland . | |
| 3,318,582 | 5/1967 | Fisher . | |
| 4,269,798 | 5/1981 | Ives | 366/327.3 X |
| 4,329,069 | 5/1982 | Graham | 366/330.1 X |
| 4,441,824 | 4/1984 | Brokaw | 366/266 |
| 4,449,826 | 5/1984 | Mathis et al. | 366/327.3 X |
| 4,506,982 | 3/1985 | Smithers et al. | 366/20 X |

FOREIGN PATENT DOCUMENTS

| | | | |
|---|---|---|---|
| 3546274 | 7/1987 | Germany | 366/20 |

*Primary Examiner*—Charles E. Cooley
*Attorney, Agent, or Firm*—Leydig, Voit & Mayer, Ltd.

[57] ABSTRACT

The mixer includes a cylindrical mixing tube substantially submerged in the liquid asphalt and a paddle assembly extending axially through the mixing tube. An auger drives the ground rubber into an upstream end portion of the mixing tube and into the liquid asphalt therein. The paddle assembly draws the ground rubber and the liquid asphalt from the upstream end portion of the mixing tube and through the mixing tube. In addition, the paddle assembly accelerates the rubber-asphalt mixture as it proceeds through the mixing tube whereupon the mixture is discharged through a downstream end of the mixing tube. The mixing tube is formed with longitudinally spaced openings to allow additional asphalt to enter the mixing tube as the velocity of the mixture increases. Curved plates which are secured to the tips of paddles aligned with the longitudinally spaced openings cover and uncover the openings to prevent the paddles from driving ground rubber and liquid asphalt outwardly through the openings as those paddles rotate past the openings. Shelves located directly upstream of the longitudinally spaced openings direct the flow of the mixture generally away from the openings to further prevent the mixture from flowing outwardly through the openings.

5 Claims, 3 Drawing Sheets

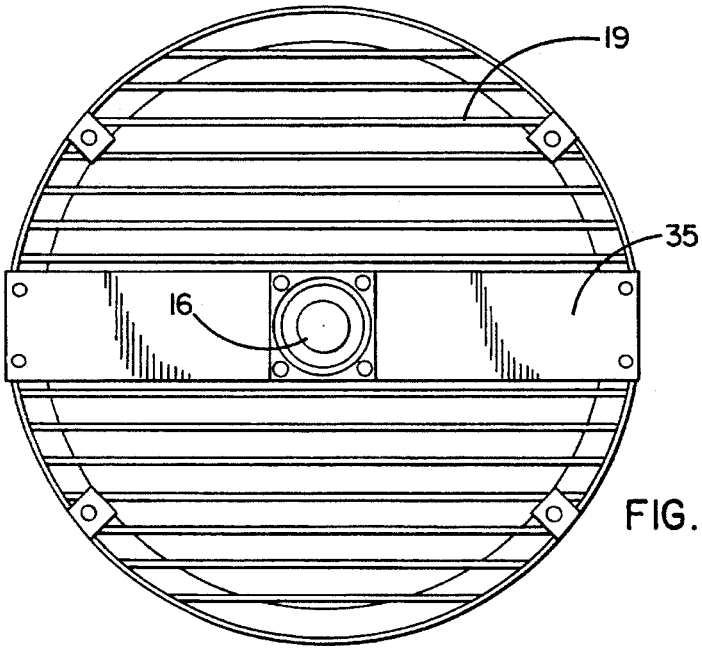
FIG. 3
FIG. 4
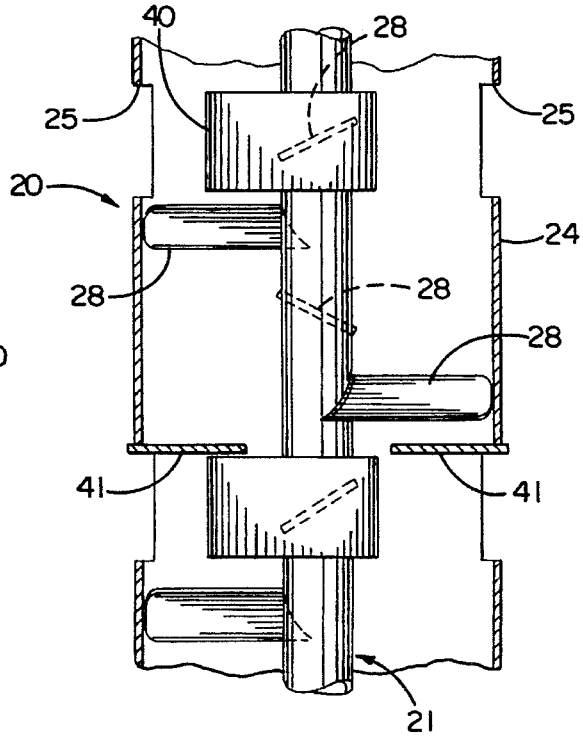
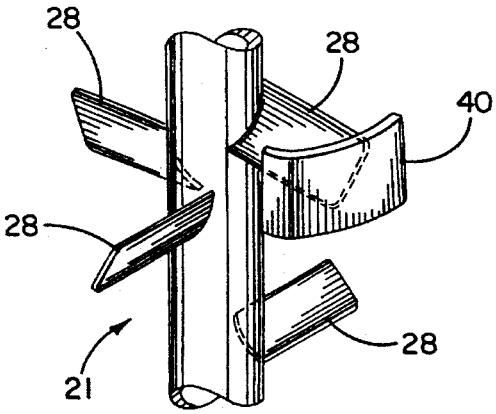
FIG. 5

PORTABLE MIXER FOR MIXING GROUND RUBBER INTO LIQUID ASPHALT

BACKGROUND OF THE INVENTION

This invention relates generally to a mixer for mixing granular material into a liquid. More particularly, the invention relates to a mixer adapted to mix powdered or ground rubber with hot, liquid asphalt.

Mixers of this general type are useful in producing a rubber-asphalt mixture which is suitable for use in, for example, road paving projects. Such a mixture can have improved strength and resilience characteristics over asphalt alone. In addition, use of such a mixture aids in disposing of used tire rubber. However, use of rubber-asphalt mixtures have been limited, in part, due to difficulties in thoroughly mixing the ground rubber with the liquid asphalt. The rubber which is mixed with liquid asphalt is a very fine powder and is typically ground to a size which will pass through a 40 to 80 mesh screen. As a result, the ground rubber has a relatively large surface area which must be thoroughly "wetted" by the liquid asphalt to create a homogenous mixture. Clumps or balls of rubber form if the surface area of the rubber is not sufficiently wetted.

In general, prior rubber-asphalt mixers draw liquid asphalt from a cargo or holding tank into a separate heated tank. The ground rubber is typically introduced into the separate tank by simply dropping the rubber on top of the liquid asphalt. Because the rubber is relatively light, it floats on top of the asphalt until it is drawn downwardly into the asphalt by a mixing device.

One such prior mixer utilizes a relatively large tank (e.g., eight to ten feet in diameter) and relatively large rotating paddles (e.g., two to three feet in length) to mix ground rubber with liquid asphalt. The paddles create a downwardly spiraling whirlpool which draws the ground rubber into the asphalt. Substantial energy is wasted in this mixer because the relatively large paddles tend to cause the entire body of liquid asphalt to revolve in the tank. Moreover, substantial energy is expended in this mixer by virtue of the relatively large paddles rotating in the mixture at a constant speed as the viscosity of the mixture increases due to an increasing percentage of rubber in the mixture.

Smithers et al U.S. Pat. No. 4,506,982 discloses a mixer which utilizes a relatively small, high-speed blending device to draw the ground rubber downwardly into the liquid asphalt and to mix the rubber and the asphalt together. While the Smithers et al arrangement provides for relatively efficient mixing of the rubber and the asphalt, such an arrangement requires the use of a separate heated tank, a cart to carry the tank, and a substantial number of pumping and associated flow control components to draw the asphalt into the tank and to pump the rubber-asphalt mixture out of the tank.

SUMMARY OF THE INVENTION

The general aim of the present invention is to provide a new and improved mixer adapted to mix ground rubber into liquid asphalt, the mixer being more efficient and of relatively simple construction when compared to prior mixers of the same general type.

A detailed objective is to achieve the foregoing by providing a portable mixer adapted to be located in a standard sized manhole opening of a standard cargo or holding tank filled with liquid asphalt.

A more detailed objective of the invention is to provide an auger for initially driving the ground rubber into the liquid asphalt.

Another more detailed objective of the invention is to provide a paddle assembly adapted to draw the liquid asphalt and the ground rubber through a mixing tube and further adapted to accelerate the rubber-asphalt mixture as it proceeds through the mixing tube.

Still another more detailed objective is to provide openings in the side of the mixing tube to allow additional asphalt to enter the mixing tube as the mixture accelerates in the mixing tube.

The invention also resides in the provision of unique means for generally preventing the mixture from flowing outwardly through the openings in the side of the mixing tube.

These and other objects and advantages of the invention will become more apparent from the following detailed description when taken in conjunction with the accompanying drawings.

BRIEF DESCRIPTION OF THE DRAWINGS

FIG. 3 is a top view as seen in the direction of the arrows of the line 3—3 of FIG. 2.

FIG. 4 is an enlarged fragmentary cross-sectional view of certain parts shown in FIG. 2.

FIG. 5 is an enlarged fragmentary perspective view of certain parts shown in FIG. 4.

Figure 1:
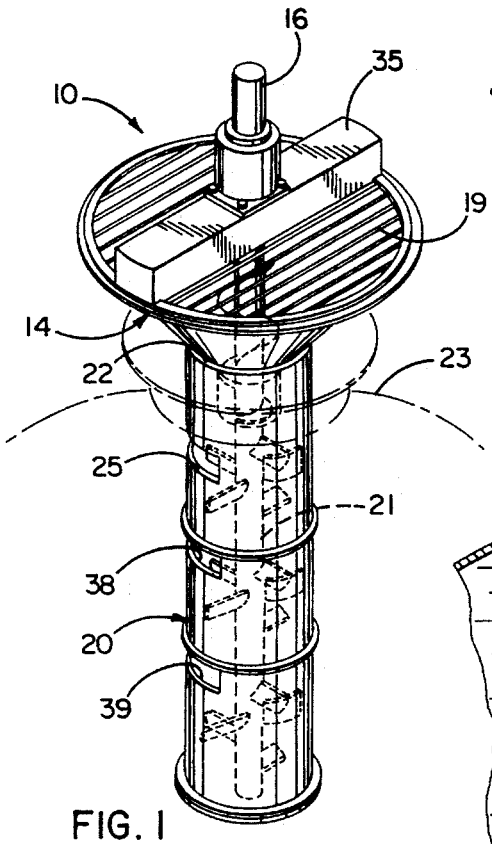
FIG. 1 is a perspective view of a new and improved rubber-asphalt mixer incorporating the unique features of the present invention and shown as installed in a tank which is illustrated in phantom lines.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Figure 2:
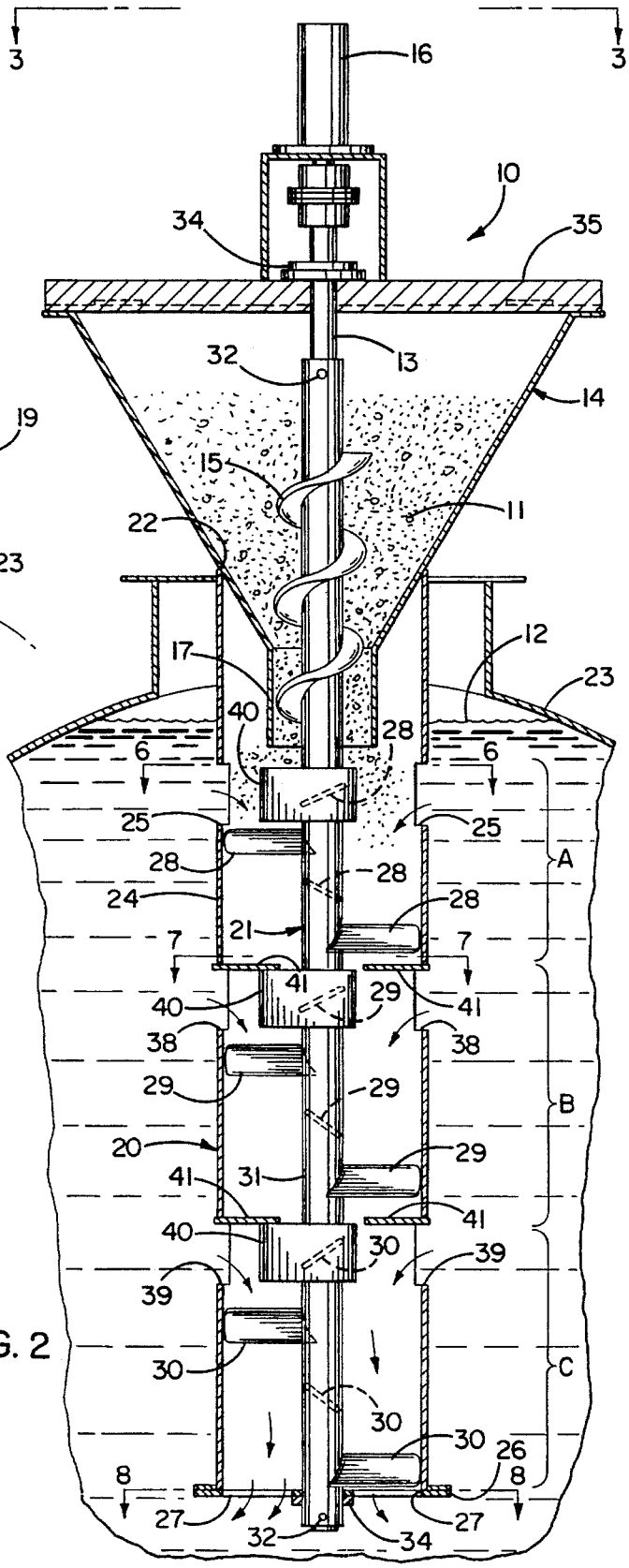
FIG. 2 is an enlarged cross-sectional view of the mixer installed in the tank.

For purposes of illustration, the present invention is shown in the drawings as embodied in a mixer 10 (FIG. 1) adapted to mix ground rubber 11 (FIG. 2) into liquid asphalt 12.

The mixer 10 includes a generally upright hopper 14 for holding a supply of ground rubber 11, an auger 15 which extends axially in the hopper, and a rotary hydraulic motor 16 for driving the auger. The hopper is frustoconically-shaped and tapers inwardly upon progressing downwardly toward a discharge end portion 17. The upper end portion of the hopper is substantially open to enable batches of ground rubber to be dumped into the hopper. A safety guard 19 secured to the open upper end of the hopper prevents relatively large foreign objects from inadvertently falling into the hopper and becoming entangled with the auger. The auger is secured to a shaft 13 which extends upwardly out of the hopper. The shaft is coupled with the hydraulic motor for driving the auger at a predetermined speed. The auger extends downwardly from the upper end portion of the hopper through the discharge end portion of the hopper. The discharge end portion is cylindrically-shaped and is sized to provide for a relatively small clearance around the auger so as to enable the auger to control the delivery rate of the ground rubber from the hopper as it is rotated by the hydraulic motor.

In accordance with one aspect of the invention, the mixer 10 includes a relatively compact mixing section 20 adapted to thoroughly mix the ground rubber 11 into the liquid asphalt 12. The mixing section is connected to the tapered lower end portion of the hopper 14 and is adapted to be substantially submerged in the liquid asphalt. In the preferred embodiment, the mixing section is adapted to extend vertically into the liquid asphalt and is sized to slip into a standard-sized manhole opening 22 of a standard cargo or holding tank 23. As a result, the mixer may be carried to and slipped into cargo tanks located at the site of, for example, road paving projects so as to enable mixing of the ground rubber into the liquid asphalt just prior to the use of the rubber-asphalt mixture.

In carrying out the invention, the mixing section 20 includes a cylindrical mixing tube 24 extending axially from the hopper 14 and a paddle assembly 21 extending axially of the mixing tube. The upper end portion of the mixing tube is secured to the tapered lower end portion of the hopper with the discharge end portion 17 of the hopper located inside the mixing tube. The mixing tube is preferably sized to be less than 20 inches in diameter so as to be capable of being slidably received into the manhole opening 22. The lower end portion of the hopper is sized to rest on the outer rim of the manhole opening. The upper end portion of the mixing tube is formed with angularly spaced inlet openings 25. An end plate 26 secured to the lower end portion of the mixing tube is formed with radially extending cross-members which define discharge openings 27.

The paddle assembly 21 is secured to the shaft 13 and includes longitudinally spaced sets of angularly spaced paddles 28, 29, and 30. The paddles extend radially outwardly from the shaft and are formed with a pitch adapted to drive liquid asphalt downwardly through the mixing tube 24 as the paddle assembly is rotated. In the embodiment shown, the auger 15 and the paddles are secured to an elongated sleeve 31 which, in turn, is slipped over the shaft and then secured to the shaft by way of threaded fasteners 32. The shaft is mounted for rotation in axially aligned bearings or bushings 34 secured to a support member 35 extending across the top of the hopper 14 and to the end plate 26.

With the foregoing arrangement, the mixer 10 is uniquely adapted to mix ground rubber 11 into the liquid asphalt 12 in the cargo tank 23. With the hopper 14 resting on the manhole opening 22 in the tank, the mixing tube 24 is suspended downwardly into the liquid asphalt with the inlet and discharge openings 25 and 27, respectively, being submerged in the asphalt. During normal operation of the mixer, the paddle assembly 21 is rotated at a relatively high speed by the hydraulic motor 16. The rotating paddle assembly draws liquid asphalt into the upper end portion of the mixing tube through the inlet openings 25 and drives the asphalt downwardly at a relatively high velocity through the mixing tube whereupon the rubber-asphalt mixture is discharged through the openings 27 at the lower end of the mixing tube.

The auger 15 delivers ground rubber into the upper end portion of the mixing tube at a predetermined rate. As a result, the ground rubber is drawn downwardly through the mixing tube with the downwardly flowing asphalt. As the ground rubber and the liquid asphalt proceed through the mixing tube, the paddles 28, 29, 30 generate substantial shearing action which operates to break up clumps of rubber in the viscous mixture and to generally mix the rubber and the liquid asphalt together before the mixture is discharged into the tank.

In keeping with the invention, the auger 15 is adapted to drive the ground rubber 11 directly into the liquid asphalt 12. More specifically, the auger and the discharge end portion 17 of the hopper 14 are sized to extend downwardly into the liquid asphalt in the upper end portion of the mixing tube 24. As a result, when the auger delivers the ground rubber to the mixing tube, the ground rubber is immediately submerged in the asphalt so as to substantially avoid the formation of clumps of rubber.

Further in accordance with the invention, the mixing section 20 is adapted to accelerate the flow of the rubber-asphalt mixture as it proceeds through the mixing tube 24 and to draw in additional asphalt 12 for mixing with the mixture flowing through the mixing tube. As a result, the ground rubber is more thoroughly mixed with the liquid asphalt in the mixing tube.

More specifically, the mixing section 20 is divided into three operationally discrete sections (see FIG. 2), namely, an upstream section, a middle section, and a downstream section as indicated at "A", "B", and "C", respectively. The spacing and the pitch of the sets of paddles 28, 29, and 30 in the upstream, middle and downstream sections, respectively, increases upon proceeding from one section to the next through the mixing tube 24. As a result, the velocity of the mixture increases upon flowing from the upstream section into the middle section and further increases upon flowing into the downstream section. Openings 38 and 39 formed in the middle and downstream sections, respectively, permit additional asphalt to be drawn into those sections of the mixing tube.

In carrying out the invention, the sets of paddles 28, 29, and 30 of each section "A", "B", and "C", respectively are equally spaced along the shaft, are angularly spaced at 90 degrees from one another, and are formed with the same pitch such the velocity of the mixture in each section is relatively constant. However, the spacing and the pitch of the paddles in the middle section is greater than the spacing and the pitch of the paddles in the upstream section. Similarly, the spacing and the pitch of the paddles in the downstream section is greater than the spacing and the pitch of the paddles in the middle section. By way of example, the spacing may be 3" between the paddles in the upstream section, 3¾" between the paddles in the middle section, and 4½" between the paddles in the downstream section. The pitch of the paddles relative to a radially extending plane may be 26 degrees in the upstream section, 32 degrees in the middle section, and 37 degrees in the downstream section. In addition, the openings 38 and 39 are preferably formed near the upstream end portions of the middle and downstream sections, respectively, and are preferably axially aligned with the upstream paddle in each of those sections. Accordingly, additional asphalt is drawn into the middle and downstream sections as the mixture begins to accelerate in those sections so as to prevent substantial cavitation of the mixture.

In keeping with the invention, curved or circumferentially extending plates 40 are secured to the tips of the upstream paddle in each of the sets of paddles 28, 29, and 30. The plates are sized to cover and then uncover each of the openings 25, 38, and 39 as the paddle which is axially aligned with that opening rotates into radial alignment with and then past that opening. As a result, the plate secured to the paddle in the upstream section "A" prevents that paddle from forcing unmixed ground rubber outwardly from the inlet opening 25 while the plates secured to the other paddles prevent those paddles from forcing the rubber-asphalt mixture outwardly through the openings 38 and 39.

Figure 6:
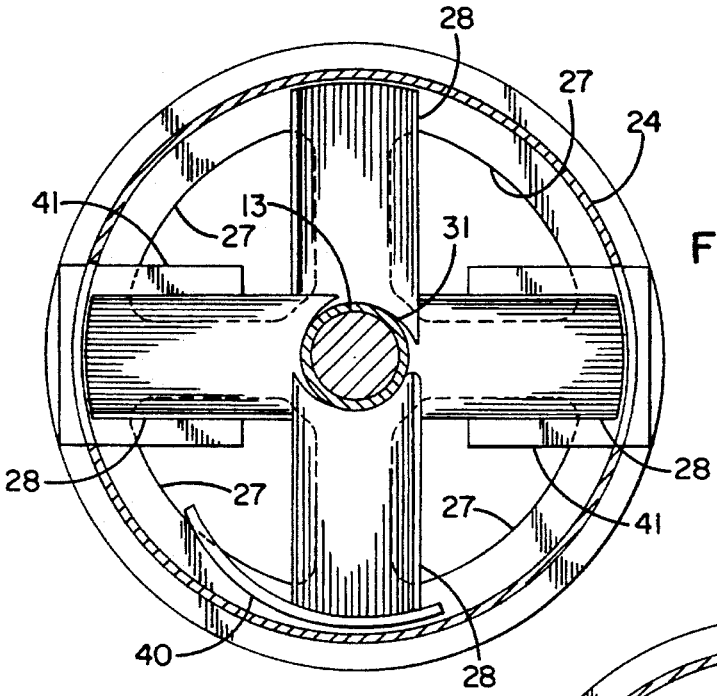
FIGS. 6, 7 and 8 are enlarged cross-sectional views taken substantially along the lines 6—6, 7—7 and 8—8, respectively, of FIG. 2.
Figure 7:
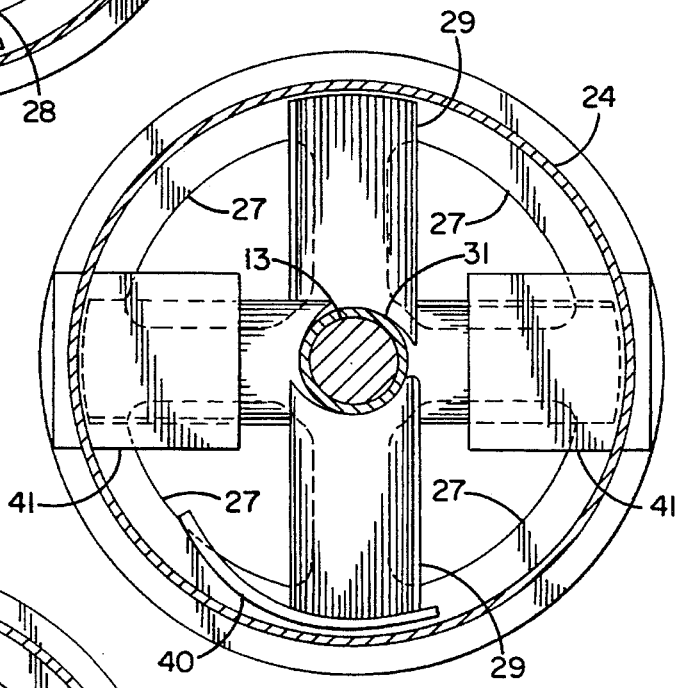
Figure 8:
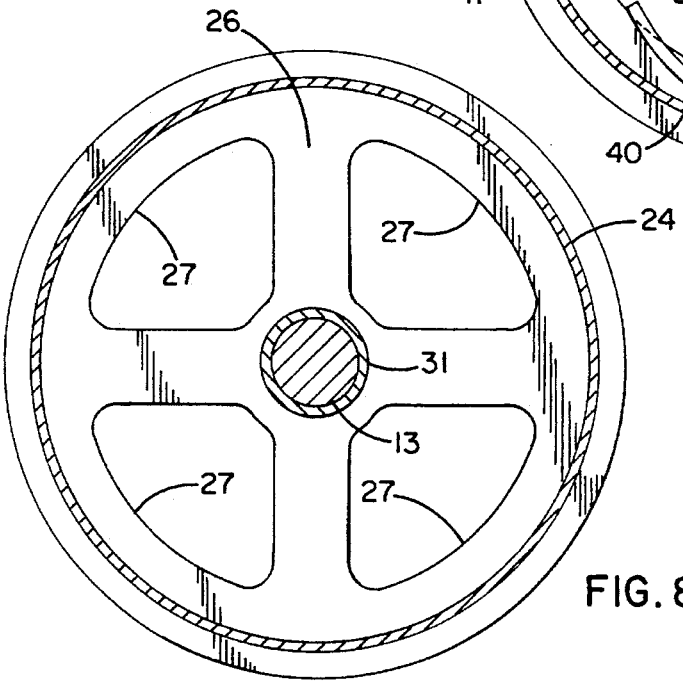

In further keeping with the invention, shelves 41 extend radially inwardly into the interior of the mixing tube 24 and are located directly above the openings 38 and 39. The shelves are secured to the upper edge portions of the openings 38, 39 and are sized to extend circumferentially across the entire width of the openings as shown in FIG. 6. The shelves deflect the rubber-asphalt mixture radially inwardly and circumferentially around the openings as the mixture proceeds through the mixing tube. As a result, the shelves further aid in preventing the mixture from flowing outwardly through the openings.

Advantageously, the downstream paddle of the sets of paddles 28 and 29 are located relatively close to the shelves 41. In addition, the downstream paddle of the set of paddles 30 is located relatively close to the end plate 26. As a result, the shelves and the end plate coact with these paddles to further aid in shearing clumps of rubber so as to completely wet the surface of the ground rubber.

From the foregoing it will be apparent that the present invention brings to the art a new and improved portable and relatively compact mixer 10 adapted to mix ground rubber 11 into liquid asphalt 12. Confining the mixing of the rubber and the asphalt to within the mixing tube 24 enables the mixer to concentrate substantial energy within a relatively small area in the tank 23 of asphalt. Immediate submersion of ground rubber by the auger 15 into a downwardly flowing stream of liquid asphalt developed by the paddle assembly 21 substantially prevents the formation of clumps of ground rubber as the rubber is mixed with the liquid asphalt. By virtue of the uniquely configured, relatively high-speed paddle assembly and the unique features of the mixing tube, the rubber and asphalt accelerate upon proceeding through the mixing tube whereupon any remaining clumps of rubber are sheared apart and the surface area of the ground rubber is thoroughly wetted with the liquid asphalt. Accordingly, the mixer is capable of cost effective, relatively efficient, and thorough mixing of ground rubber with liquid asphalt.

We claim:

1. A mixer for mixing ground rubber into liquid asphalt, said mixer comprising a generally cylindrical mixing tube having inlet and outlet end portions, said inlet end portion having a first opening, said outlet end portion being substantially open, means for supplying the ground rubber into said inlet end portion, a shaft extending axially through the center of said mixing tube, said shaft being mounted for rotation relative to said mixing tube, means for rotating said shaft, first and second sets of paddles secured to said shaft for rotation with said shaft, said sets being longitudinally spaced on said shaft with said second set being located downstream of said first set, said paddles extending radially outwardly from the shaft and being formed with outer tip portions, said paddles being formed with a pitch adapted to draw liquid asphalt through said first opening and being adapted to drive the liquid asphalt and the ground rubber from said inlet end portion and through said mixing tube for discharging of a rubber asphalt mixture from said outlet end portion, said paddles of said first set having a first predetermined pitch and being longitudinally spaced from one another by a first predetermined distance, said paddles of said second set having a second predetermined pitch and being longitudinally spaced from one another by a second predetermined distance, said second predetermined pitch and said second predetermined distance being greater than said first predetermined pitch and said first predetermined distance, respectively, such that the velocity of the mixture increases as the mixture proceeds from said first set of paddles to said second set of paddles, and a second opening longitudinally positioned in said mixing tube so as to allow additional liquid asphalt to flow into said mixing tube and to mix with the mixture in said mixing tube as the velocity of the mixture increases.

2. A mixer as defined in claim 1 in which said supplying means is operable to drive the ground rubber into the liquid asphalt in said inlet end portion of said mixing tube independently of the operation of said paddles.

3. A mixer as defined in claim 1 further comprising a curved plate member secured to the tip portion of an upstream paddle of said second set of paddles, said second opening being longitudinally aligned with said upstream paddle, said plate member being sized to substantially cover and then to uncover said second opening as said upstream paddle rotates into and then out of radial alignment with said second opening.

4. A mixer as defined in claim 3 further comprising a second curved plate member secured to the tip portion of an upstream paddle of said first set of paddles, said first opening being longitudinally aligned with said upstream paddle of said first set of paddles, said second plate member being sized to substantially cover and then to uncover said first opening as said upstream paddle of said first set of paddles rotates into and then out of radial alignment width said first opening.

5. A mixer as defined in claim 1 further comprising a shelf portion extending radially inwardly into said mixing tube, said shelf portion being located upstream and adjacent said second opening so as to cause the mixture to flow radially inwardly and circumferentially around the interior of said mixing tube as the mixture flows past said second opening.

* * * * *